US008800723B2

(12) United States Patent
De Jong et al.

(10) Patent No.: US 8,800,723 B2
(45) Date of Patent: Aug. 12, 2014

(54) ELEVATOR SYSTEM HAVING FLOORS LOCKED FROM RECEIVING SERVICE

(71) Applicant: Kone Corporation, Helsinki (FI)

(72) Inventors: Johannes De Jong, Järvenpää (FI); Maarten Van Dijk, Rijswik (NL); Marja-Liisa Siikonen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/840,395

(22) Filed: Mar. 15, 2013

(65) Prior Publication Data

US 2013/0206517 A1 Aug. 15, 2013

Related U.S. Application Data

(63) Continuation of application No. PCT/FI2010/050755, filed on Sep. 30, 2010.

(51) Int. Cl.
*B66B 1/16* (2006.01)

(52) U.S. Cl.
USPC ..... 187/388; 187/393

(58) Field of Classification Search
USPC ..... 187/247, 380–389, 391–393
See application file for complete search history.

(56) References Cited

U.S. PATENT DOCUMENTS

| | | | | | |
|---|---|---|---|---|---|
| 3,589,472 | A | * | 6/1971 | Hallene et al. | 187/386 |
| 3,625,311 | A | * | 12/1971 | Nowak et al. | 187/380 |
| 3,746,131 | A | * | 7/1973 | Hirasawa et al. | 187/380 |
| 3,967,702 | A | * | 7/1976 | Iwaska et al. | 187/387 |
| 4,149,613 | A | * | 4/1979 | Yoneda et al. | 187/387 |
| 4,836,336 | A | * | 6/1989 | Schroder | 187/384 |
| 4,895,223 | A | | 1/1990 | Ekholm et al. | |
| 5,086,883 | A | * | 2/1992 | Schroder | 187/258 |
| 5,168,133 | A | * | 12/1992 | Bahjat et al. | 187/247 |
| 5,183,981 | A | * | 2/1993 | Thangavelu | 187/383 |
| 5,200,583 | A | * | 4/1993 | Kupersmith et al. | 187/384 |
| 5,307,903 | A | * | 5/1994 | Morita et al. | 187/382 |
| 5,317,114 | A | * | 5/1994 | Pullela et al. | 187/383 |
| 5,382,761 | A | * | 1/1995 | Amano | 187/383 |
| 5,679,934 | A | * | 10/1997 | Juntunen et al. | 187/395 |
| 5,831,226 | A | * | 11/1998 | Hattori et al. | 187/382 |
| 5,892,190 | A | * | 4/1999 | Morita et al. | 187/382 |
| 6,293,368 | B1 | * | 9/2001 | Ylinen et al. | 187/382 |
| 6,401,874 | B2 | * | 6/2002 | Siikonen | 187/382 |
| 7,040,458 | B2 | * | 5/2006 | Forsythe et al. | 187/396 |

(Continued)

FOREIGN PATENT DOCUMENTS

| | | | |
|---|---|---|---|
| CN | 1030731 | A | 2/1989 |
| CN | 101402426 | A | 4/2009 |

(Continued)

OTHER PUBLICATIONS

Translation JP 06001547A.*

*Primary Examiner* — Anthony Salata
(74) *Attorney, Agent, or Firm* — Birch, Stewart, Kolasch & Birch, LLP

(57) ABSTRACT

The present invention provides a solution for optimizing the transport capacity of an elevator system. For optimizing the transport capacity the elevator system dynamically locks floors served by it on the basis of defined locking rules. When a floor is locked, that floor can not be considered a designation floor or receive elevator calls.

18 Claims, 2 Drawing Sheets

(56) References Cited

U.S. PATENT DOCUMENTS

Figure 1:
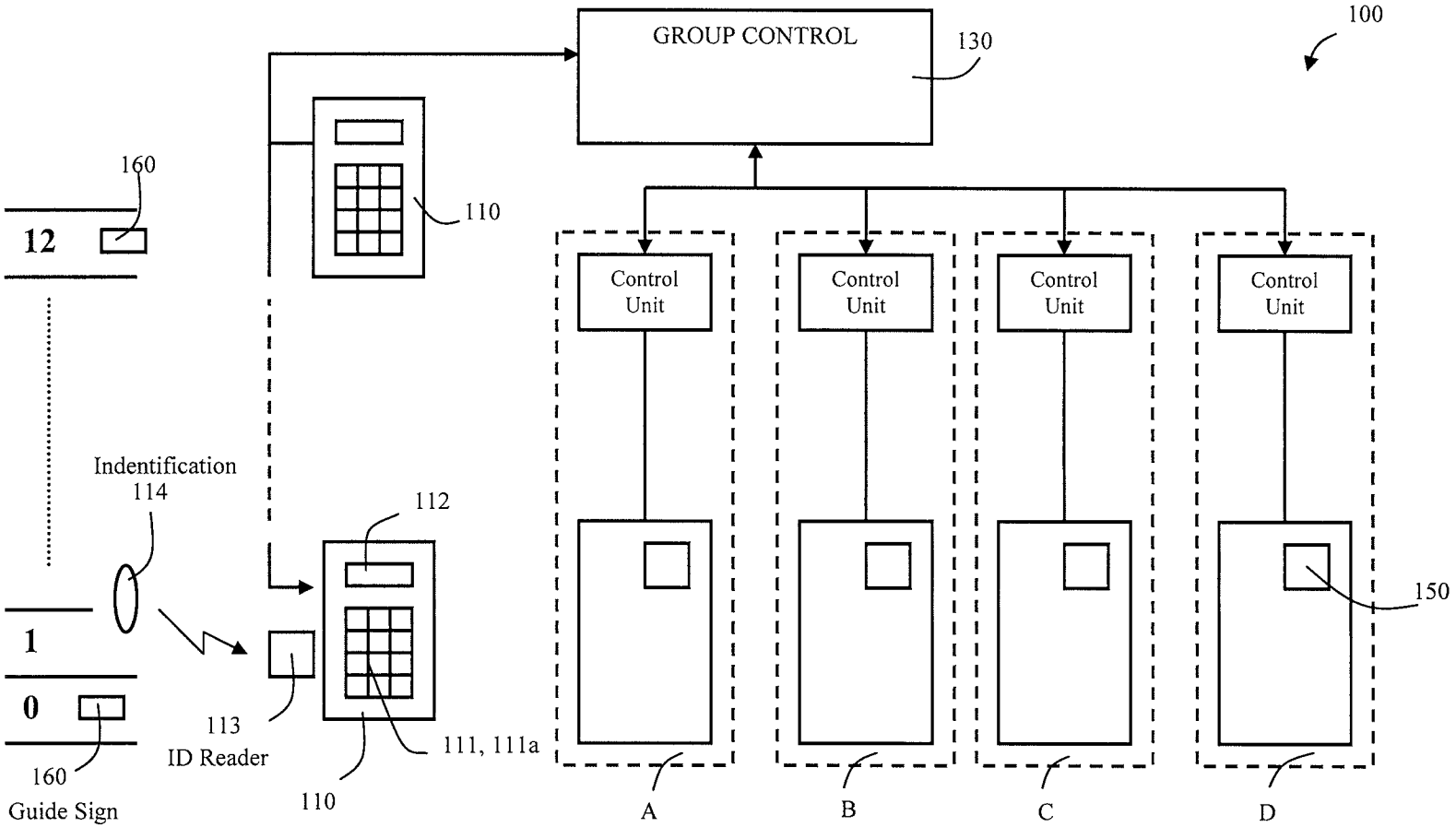

| | | | | |
|---|---|---|---|---|
| 7,083,027 | B2 * | 8/2006 | Siikonen et al. | 187/383 |
| 7,108,106 | B2 * | 9/2006 | Kostka | 187/391 |
| 7,387,191 | B2 * | 6/2008 | Kostka et al. | 187/381 |
| 7,487,861 | B2 * | 2/2009 | LaBarre et al. | 187/383 |
| 7,490,698 | B2 * | 2/2009 | Sirag, Jr. | 187/381 |
| 7,694,781 | B2 * | 4/2010 | Sorsa et al. | 187/382 |
| 7,823,700 | B2 * | 11/2010 | Boss et al. | 187/384 |
| 8,387,756 | B2 * | 3/2013 | Laihanen et al. | 187/387 |
| 2003/0155187 | A1 * | 8/2003 | Jarrett | 187/388 |
| 2005/0077114 | A1 * | 4/2005 | Kostka et al. | 187/381 |
| 2005/0109562 | A1 | 5/2005 | Siikonen et al. | |
| 2009/0020370 | A1 * | 1/2009 | Boss et al. | 187/247 |

FOREIGN PATENT DOCUMENTS

| | | | |
|---|---|---|---|
| CN | 101456502 | A | 6/2009 |
| CN | 101641274 | A | 2/2010 |
| CN | 101670961 | A | 3/2010 |
| JP | 06001547 | A * | 1/1994 |
| WO | WO 2009/122002 | A1 | 10/2009 |

* cited by examiner

ELEVATOR SYSTEM HAVING FLOORS LOCKED FROM RECEIVING SERVICE

CROSS REFERENCE TO RELATED APPLICATIONS

This application is the Continuation of PCT/FI2010/050755 filed on Sep. 30, 2010, all of which is hereby expressly incorporated by reference into the present application.

FIELD OF THE INVENTION

The invention relates to elevator systems. More particularly, the invention relates to the dynamic optimization of the transport capacity of elevator systems during peak hours.corrected/mjc

BACKGROUND OF THE INVENTION

One dimensioning principle of elevator systems installed in buildings is their ability to serve elevator passengers in various traffic situations within a framework of desired service targets. Generally the transport capacity of an elevator system is dimensioned according to peak hours and not, e.g. according to average traffic needs, which means inter alia that the number of elevators of the elevator system must be selected to be so high that the elevator system can manage to meet the service targets set also during peak hours. The peak hours are often short-lived and in some cases even forecastable on the basis of the statistical information collected about the travel events of the elevator system. For instance, in office buildings it is typical that people working in the building arrive at their workplace at roughly the same time in the morning and cause so-called upward congestion in the elevator system and, correspondingly, when they leave the workplaces in the afternoon they cause so-called downward congestion in the elevator system. During other times outside peak hours an elevator system generally has unused transport capacity owing to the quieter traffic, in which case elevators stand unoccupied or they are underutilized most of the time.

Owing to the peak hours the elevator system must thus be "overdimensioned", which causes considerable additional costs because, among other things, the speeds and number of elevators and/or the hoistway space required by elevators must be increased in order to achieve the desired transport capacity.

The number of stops made by elevators on the routes between the floors considerably affects the transport capacity of an elevator system and at the same time the number of elevators required. One prior-art method for improving the transport capacity and for reducing the number of stops is to use a destination control system for the control of the elevator system, in which control system each passenger indicates already at the departure floor the destination floor, to which he/she is traveling. Another prior-art method for improving the transport capacity and for reducing the number of stops is to divide the floors into zones such that each zone is served only by certain elevators of the elevator system. Elevator systems according to prior art, however, adapt badly to the traffic flows during peak hours, as a result of which the waiting times of passengers and/or other service times can increase to become unreasonable, if the elevator system is not sufficiently "overdimensioned" with respect to average traffic needs. There is thus a need for elevator systems that can better adapt to traffic flows during peak hours so that the need for overdimensioning of elevator systems would diminish and the elevator systems installed in buildings could be implemented more simply and with fewer elevators.

AIM OF THE INVENTION

The aim of the present invention is to eliminate or at least to alleviate the aforementioned drawbacks that occur in prior-art solutions. The aim of the invention is also to achieve one or more of the following objectives:

- To reduce the space requirement and/or the number of elevators in buildings,
- To improve the transport capacity of elevator systems particularly in an elevator system subjected to a forecast and/or prevailing congestion,
- To improve the average utilization rate of elevators,
- An elevator system, the transport capacity of which automatically adapts to a prevailing traffic situation,
- To "equally" serve passengers in an elevator system, and
- To better take into account the needs of special groups in the elevator service.

SUMMARY OF THE INVENTION

Some inventive embodiments are presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

The present invention discloses a method for optimizing the transport capacity of an elevator system. The elevator system serves two or more floors in a building and comprises at least one elevator and also call-giving appliances for registering calls given by the passengers. In the method one or more floors served by the elevator system are dynamically locked based on defined locking rules. Locking of a floor in this context means that elevators of an elevator system do not serve a locked floor, i.e. elevator cars do not stop at a locked floor for the purpose of leaving/collecting passengers at the floor/from the floor. The number of locked floors is a variable magnitude and depends on meeting the conditions defined by the locking rules.

The present invention also discloses an elevator system, which comprises at least one elevator, a control system, and call-giving appliances connected to the control system for registering the calls given by the passengers. The control system is arranged to dynamically lock one or more floors served by the elevator system on the basis of the locking rules recorded in the control system.

In one embodiment of the invention a destination call given by a passenger to a locked floor is registered. On the basis of the destination call, an elevator car is allocated to the passenger for the purpose of taking the passenger from the departure floor to an unlocked floor, from which there is an alternative passageway to the locked floor. A destination call refers to a call given from outside the elevator car, which call defines both the departure floor (call floor) and the destination floor to which the passenger is traveling (target floor). An alternative passageway in this context refers to a route formed by stairs and/or escalators and/or travelators, using which a passenger can move from an unlocked floor to a locked floor or vice versa. An unlocked floor, to which according to the embodiment the passenger is taken with an elevator, is disposed, according to the opportunities, immediately above or immediately below the locked floor to which the passenger is traveling. In order for the passenger to arrive at his/her destination conveniently, he/she can be guided in connection with giving a call and/or during the elevator trip, e.g. to exit from the elevator car at an unlocked floor according to the route and to move using the alternative passageway to the locked floor, to which he/she on the basis of the call is traveling.

In one embodiment of the invention the giving of calls is prevented at the locked floor and the passengers are guided from the locked floor to a suitable/the nearest unlocked floor that the elevators of the elevator system serve. As a result of the embodiment, the giving of unnecessary calls on locked floors can be prevented and the passengers can be guided to move to the nearest unlocked floor from which the giving of calls to elevators is possible.

In one embodiment of the invention the performance indicator describing the transport capacity of the elevator system is monitored and if the value of the performance indicator exceeds the given limit value, at least one of the floors served by the elevator system is locked. The monitored performance indicator is, e.g. an average waiting time, which indicates how fast the elevator system can serve the passengers waiting for transportation in the elevator lobbies. As a result of the embodiment, the situations where e.g. the average waiting times and/or maximum waiting times exceed the given limit value can be automatically identified, and the transport capacity can be immediately increased and also the waiting times shortened by locking floors from the plurality of floors served by the elevator system.

In one embodiment of the invention statistical information about the travel events of the elevator system is collected, based on which information the periods of time during which the performance indicator describing the transport capacity of the elevator system probably exceeds the given limit value are forecast. On the basis of the forecast periods of time, one or more floors served by the elevator system are locked, in which case the number of stops decreases and the transport capacity increases. As a result of the embodiment, the elevator system can be prepared in good time for future peak hours and thus the service of passengers can be improved in the elevator system.

In one embodiment of the invention the effect of the locking on the transport capacity of the elevator system is simulated and the floors to be locked are selected based on the aforementioned simulation. As a result of the embodiment, the floors for which locking has the best positive effect on the transport capacity of the elevator system can be automatically determined.

In one embodiment of the invention a passenger is identified in connection with giving a call as a passenger belonging to a special group. On the basis of the identification the passenger is permitted to travel to one or more locked floors. As a result of the embodiment, special groups, e.g. physically handicapped people, can be served such that they can travel directly to the locked floor if they so desire. Identification can be based on, e.g. an electrical identifier, camera identification, the use of a pushbutton indicating a special transport or an identification method applicable for some other purpose.

In one embodiment of the invention one or more of the lowest floors are locked. The lowest floors refer to the floors immediately above the entrance lobby and also any floors possibly immediately below the entrance lobby, e.g. parking hall floors, from which there is an access along the stairs and/or escalators to the entrance lobby. If one of the lowest floors is locked, an elevator is not necessarily allocated to the passenger for moving from the aforementioned lowest floor to the entrance lobby or vice versa, but instead the passenger must use an alternative passageway. As a result of the embodiment, the transport capacity of the elevator system can be considerably increased by guiding the passengers from the lowest floors directly to the entrance lobby, e.g. during exiting traffic, without said passengers using elevators in order to exit from the building.

In one embodiment of the invention a floor to be locked is selected by evenly distributing the floor-specific locking times within a desired period of time (equalization period). In the embodiment the floors to be locked are varied, e.g. daily, such that the locking time is equalized between the desired floors, e.g. at one week intervals. As a result of the embodiment, passengers visiting different floors receive on average equal service in the elevator system. The floors can also be divided into zones on the basis of user groups and the floors to be locked can be selected by evenly distributing the zone-specific locking times within the desired period of time. As a result of the embodiment, passenger groups using different zones receive on average equal service in the elevator system.

With the solution according to the invention the transport capacity of the elevator system can be increased particularly during peak hours by leaving some of the floors without service and thus by reducing stops of the elevators. Owing to the invention the arrival of passengers at their destination speeds up although a part of the passengers must use stairs and/or escalators for a part of the journey in order to arrive at their destination floor. Arrival of the passengers at the destination can be facilitated by guiding them from the locked floors to the nearest floors that are served by the elevators of the elevator system. Correspondingly, if the destination floor of the passenger is a locked floor, the passenger can be guided during the elevator trip and thus his/her arrival at the destination facilitated and speeded up. Passengers and/or user groups can be equally served by equalizing the floor-specific and/or zone-specific locking periods with each other. The needs of special groups can also be taken into account in the elevator services by identifying a passenger, e.g. to be a physically handicapped person, and by permitting him/her travel to the locked floors. Overall, with the solution according to the invention the service ability of an elevator system can be improved particularly during peak hours, the elevator system can be simplified and even the number of elevators needed in a building can be reduced.

LIST OF FIGURES

In the following, the invention will be described in detail by the aid of examples of its embodiments, wherein:

FIG. 1 presents one elevator system according to the invention; and

Figure 2:
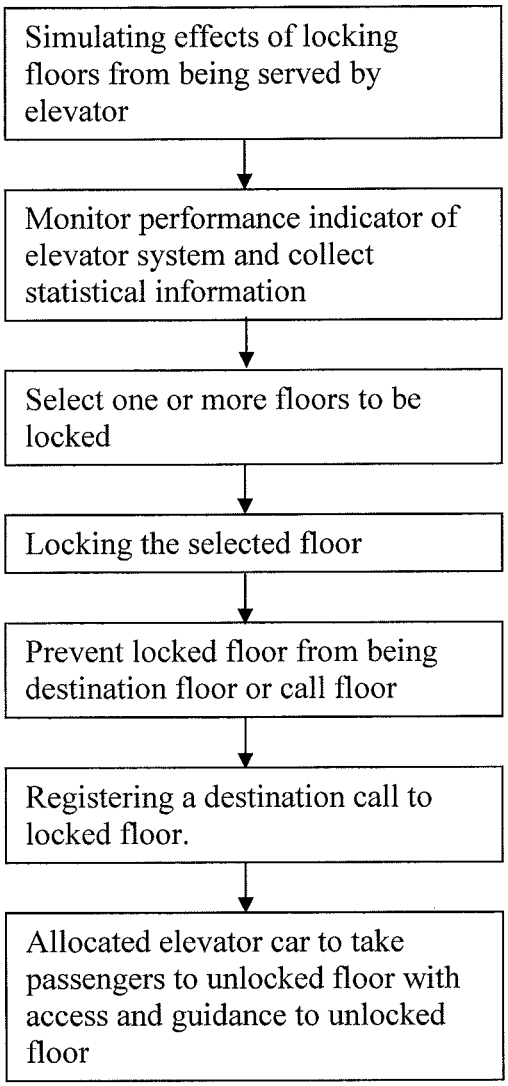

FIG. 2 is a flow chart of the invention.

DETAILED DESCRIPTION OF THE INVENTION

FIG. 1 illustrates an elevator system 100 according to the invention, which system comprises elevators A, B, C and D, a control system 130 (group control) controlling the elevator system, and also call-giving appliances 110 disposed in the elevator lobbies of floors 0-12. The call-giving appliances 110 are destination call panels suitable for giving destination calls and comprising destination call pushbuttons 111 and a display 112. A part of the call-giving appliances in the elevator lobbies can be implemented with conventional up/down pushbuttons, in which case this is a so-called hybrid system. An elevator system according to the invention can also be implemented as a conventional elevator system by using just up/down pushbuttons as call-giving appliances in the elevator lobbies. The call-giving appliances 110 can also be provided with a reader apparatus 113 that can read the information comprised in a personal identifier 114 in the possession of a passenger. The identifier 114 is, e.g. an identifier based on the RFID technology. The call-giving appliance can also be provided with special classification pushbuttons 111*a*, with which, e.g. a physically handicapped passenger can order a special transport for himself/herself.

The control system 130 comprises a memory, a processor unit and software, which when executed in a processor unit performs control procedures of the elevator system. Information about the floors served by the elevator system is also recorded in the memory of the control system, which floors in the situation according to FIG. 1 can comprise floors 0-12.

The control system 130 registers calls given by the passengers with the call-giving appliances 110 and allocates the optimal elevator cars for the use of passengers on the basis of the calls and of the status information of the elevator system. Allocation can be based on, e.g. genetic allocation methods or other allocation methods that are per se known in the art. On the basis of the allocation results, the control system 130 sends the necessary control commands to the elevator-specific control units C1, C2, C3 and C4.

According to the invention the control system locks floors served by the elevator system according to the given locking rules. By means of the locking rules the control system endeavors to select the floors to be locked, on the one hand, such that the transport capacity of the elevator system would be improved as much as possible and, on the other hand, such that people traveling to the different floors would receive equal service in the elevator system. The locking rules can be defined, e.g. on the basis of the predictability of the passenger flows of the building. Peak hours can be predefined in buildings where the behavior of passenger flows is highly forecastable, in which case one or more floors are worth locking in order to improve the transport capacity of the elevator system. For instance, in office buildings the number of employees visiting the building, the floor at which each employee is working as well as the time of arrival and departure to/from work are often known. Locking periods can thus be determined manually and configured into the control system, e.g. in connection with the commissioning of the elevator system and/or a service visit. It is also possible that a configuration terminal is connected to the control system, by means of which terminal the customer (the building owner or other corresponding party) can monitor the transport capacity of the elevator system and/or change the locking rules.

If the passenger flows of the building cannot be forecast with sufficient accuracy, the control system can monitor the travel events of the elevator system and based on them make inferences about the traffic situation prevailing in the elevator system at any given time and also as to whether the transport capacity of the elevator system is sufficient for achieving the desired service targets. On the basis of the travel events, the control system can determine the value of one or more performance indicators, which value describes the transport capacity of the elevator system. The aforementioned performance indicators are, e.g. an average waiting time, maximum waiting time, travel time, average car load, the number of given calls, number of stops of elevators, or a suitably weighted sum of the aforementioned performance indicators. The value of the performance indicator is calculated, e.g. on the basis of travel events registered during the last 5 minutes. When the control system detects that the value of the performance indicator to be monitored exceeds the pre-determined limit value (the so-called first limit value), the control system locks at least one floor that is served by the elevator system. If despite the locking the transport capacity of the elevator system is still not sufficient for serving passengers (e.g. the waiting time still exceeds the given limit value), the control system locks more floors until the transport capacity of the elevator system is on the basis of the monitored performance indicators sufficient. Correspondingly when the congestion in due course ceases and the value of one or more performance indicators to be monitored falls below the given second limit value, the control system removes the locking of at least one floor. The procedure can be repeated until the locking of all floors is removed.

Long-term traffic statistics about travel events can also be collected and the periods of time when one or more performance indicators describing the transport capacity of the elevator system will probably exceed the preset limit value can be forecast. On the basis of the periods of time in question the control system can forecast future congestions and lock one or more floors in advance. The forecast period can be, e.g. a week, in which case day-specific forecasts can be made for each day of the week.

The floors, from which the floors to be locked are selected at any given time, can be determined either manually or automatically. In the manual determination information about the floors used for locking is recorded in the memory of the control system, e.g. in connection with the commissioning of the elevator system. Automatic determination can, on the other hand, occur e.g. by simulating the operation of the elevator system such that during simulation the floors are "virtually" locked one after the other and the effect of the locking on one or more performance indicators describing the transport capacity of the elevator system, e.g. on the waiting time, is calculated. The floors, for which the effect of their locking on the performance indicator is the highest, are selected as the floors to be locked. Long-term statistical information collected about travel events can, for instance, be used for generating calls and other travel events needed in the simulation.

When the floors to be used for locking are determined, the floor to be locked at that time is selected from the aforementioned plurality of floors on the basis of the locking rules recorded in the memory of the control system 130. One possibility is to start the locking of floors from the lowest floors, in which case the passengers of the floors in question can use stairs, e.g. during exiting traffic. The floor to be locked can also be selected such that the floor-specific locking times will be evenly distributed within the desired equalization period. For instance, by locking different floors on different weekdays the floor-specific locking times will be equalized in intervals of one week. The floor-specific locking times can also be equalized by registering the locking times of floors and by locking at any given time the floor for which the sum of locking times is the lowest during the equalization period. The floors can also be divided into zones and the locking times can be evenly distributed by zones. Division into zones can be based on, e.g. user groups of the building (residents, company X, company Y, etc.).

When the control system locks a floor, the passengers are informed of the locking and they are guided to move, e.g. using stairs to a lower unlocked floor. The display 112 of the call-giving appliance 110 on the floor in question and/or a guide sign 160 in the elevator lobby of the floor in question can be used for guidance.

If a passenger gives a destination call to a locked floor, the control system allocates the elevator car for taking the passenger from the departure floor to the nearest unlocked floor, from which there is an alternative passageway to the aforementioned locked floor. The unlocked floor is preferably a floor immediately below or above the locked floor. The passenger must thus use stairs and/or escalators in order to arrive at the destination floor, but because owing to the locking, e.g. the waiting time of the passenger at the departure floor shortens, his/her arrival at the destination can become faster despite the section of travel performed along the stairs and/or escalators. With the display 112 of the call-giving appliance the passenger can be notified of the elevator allocated and also of the floor at which the passenger must exit from the elevator car. The passenger can also be guided in the elevator car by means of guidance means 150 by urging him/her to exit from the elevator car at the right floor and to use stairs from the exit floor to the locked floor to which he/she was traveling on the basis of the call.

To avoid those passengers belonging to special groups, e.g. passengers using wheelchairs, from unreasonably suffering from the locking of the floors, the locking can be "by-passed" for each specific passenger, if the passenger can be identified to be a passenger belonging to some special group. The identification can be based on e.g. the use of the classification pushbutton 111*a* in the call-giving appliance 110. By pushing the classification pushbutton 111*a* the passenger can indicate himself/herself to be e.g. physically handicapped and can order elevator transport to a locked floor. Alternatively, the identification can be based on an electrical identifier, the information contained in which is read, e.g. in connection with giving a call, with a reader apparatus 113 and transmitted to the control system. The identification can also be based on an identification made on the basis of a camera picture, in which identification using image processing methods that are per se known in the art, and the passenger can be identified, e.g. as a passenger using a wheelchair.

FIG. 2 is a flow chart of the invention.

The invention is not only limited to be applied to the embodiments described above, but instead many variations are possible within the scope of the inventive concept defined by the claims below.

The invention claimed is:

1. A method for optimizing the transport capacity of an elevator system, the elevator system serving two or more floors in a building the method comprising:

locking at least one floor served by the elevator system;

preventing a locked floor from being designated as a destination floor or a call floor;

registering a destination call to a locked floor given by a passenger on a call floor; and allocating an elevator car to the passenger for taking the passenger from the call floor to an unlocked floor, from which there is an alternative passageway to the locked floor.

2. The method according claim 1, further comprising:

monitoring at least one performance indicator describing the transport capacity of the elevator system; and locking one or more floors served by the elevator system when a value of the performance indicator exceeds a predetermined limit value.

3. The method according to claim 2, further comprising:

collecting statistical information about travel events of the elevator system;

forecasting periods of time during which the value of the performance indicator describing the transport capacity of the elevator system will exceed the predetermined limit value using the statistical information; and locking the one or more floors served by the elevator system for the duration of the forecasted periods of time.

4. The method according to claim 1, wherein one or more floors to be locked are selected from a plurality of lowest floors.

5. A method for optimizing the transport capacity of an elevator system, the elevator system serving two or more floors in a building the method comprising:

locking at least one floor served by the elevator system;

preventing a locked floor from being designated as a and destination floor or a call floor;

simulating the effect of locking one or more floors on the transport capacity of the elevator; and selecting the one or more floors to be locked on the basis of the simulation.

6. The method according to claim 1, further comprising:

identifying a passenger giving a call as a passenger belonging to a special group; and permitting travel to one or more locked floors on the basis of the identification.

7. The method according to claim 1, further comprising:

selecting the floor to be locked by evenly distributing the floor-specific locking times and/or zone-specific locking times within a desired equalization period.

8. An elevator system, comprising:

at least one elevator;

a control system of the elevator system; and call-giving appliances connected to the control system for registering calls given by passengers, wherein the control system is arranged to lock at least one floor served by the elevator system, and prevent a locked floor from being designated as a destination floor or a call floor, and wherein the control system registers a destination call given by a passenger and if the destination call is to a locked floor, allocates an elevator car to the passenger to take the passenger to an unlocked floor, from which there is an alternative passageway to the locked floor.

9. The elevator system according to clam 8, further comprising a guide to alternative passageways between locked floors and unlocked floors.

10. The elevator system according to claim 8, wherein the control system monitors at least one performance indicator describing the transport capacity of the elevator system and locks one or more floors served by the elevator system if the value of the performance indicator exceeds a predetermined limit value.

11. The elevator system according to claim 8, wherein the control system is arranged to select the floor to be locked from a plurality of lowest floors.

12. An elevator system, comprising:

at least one elevator;

a control system of the elevator system; and call-giving appliances connected to the control system for registering calls given by passengers, wherein the control system is arranged to lock at least one floor served by the elevator system, and prevent a locked floor from being designated as a destination floor or a call floor, and wherein the control system simulates the effect of locking a floor on the transport capacity of the elevator system and selects one or more floors to be locked on the basis of the simulation.

13. The elevator system according to claim 8, wherein the elevator system collects statistical information about the travel events of the elevator system, forecasts the transport capacity of the elevator system on the basis of the statistical information, and locks one or more floors on the basis of the forecasts.

14. The elevator system according to claim 8, further comprising:

an identifier for a passenger belonging to a special group, and permitting travel to a locked floor on the basis of the identification.

15. The elevator system according to claim 8, wherein the guidance system is arranged to evenly distribute the floor-specific locking times and/or zone-specific locking times within the desired equalization period.

16. The method according to claim 2, wherein the at least one performance indicator is average wait time or maximum wait time at a call floor.

17. The method according to claim 1, further comprising providing an unlocked floor immediately above or below the at least one locked floor.

18. The elevator system according to claim 10, wherein the at least one performance indicator is average wait time or maximum wait time at a call floor.

* * * * *